US005077918A

United States Patent [19]

Garman

[11] Patent Number: 5,077,918

[45] Date of Patent: Jan. 7, 1992

[54] CUTTING EDGE ASSEMBLY FOR AN IMPLEMENT

[75] Inventor: James A. Garman, Eureka, Ill.

[73] Assignee: Caterpillar Inc., Peoria, Ill.

[21] Appl. No.: 580,390

[22] Filed: Sep. 10, 1990

[51] Int. Cl.[5] ..... E02F 9/28; E02F 3/80; A01B 23/02

[52] U.S. Cl. ..... 37/141 T; 37/142 R; 37/DIG. 12; 172/701.3; 172/719; 172/772.5; 299/93

[58] Field of Search ..... 37/141 R, 141 T, 142 R, 37/142 A, DIG. 12; 172/701.3, 719, 713, 772.5; 299/91, 93; 411/361, 338-339, 383-384, 546

[56] References Cited

U.S. PATENT DOCUMENTS

| | | | |
|---|---|---|---|
| 1,856,930 | 5/1932 | Robin | 37/142 R |
| 2,688,475 | 9/1954 | Small | 37/142 R X |
| 2,841,896 | 7/1958 | Meshorer | 37/142 R |
| 3,371,437 | 3/1968 | Wilson et al. | 37/142 R |
| 3,497,973 | 3/1970 | Campbell | 37/141 R |
| 3,762,079 | 10/1973 | Lukavich et al. | 37/141 R |
| 3,831,297 | 8/1974 | Lanz et al. | 37/141 R |
| 3,841,007 | 10/1974 | Howarth et al. | 37/141 R |
| 3,845,578 | 11/1974 | Holmstrom | 37/142 R X |
| 3,851,413 | 12/1974 | Lukavich | 37/141 T |
| 3,864,853 | 2/1975 | Klett et al. | 37/142 R X |
| 3,914,885 | 10/1975 | Moreau | 37/141 R |
| 3,997,988 | 12/1976 | Klett | 37/142 R X |
| 4,052,803 | 10/1977 | Lanz et al. | 37/142 R X |
| 4,068,594 | 1/1978 | Crowell | 104/10 |
| 4,074,449 | 2/1978 | Lanz et al. | 37/141 R X |
| 4,128,132 | 5/1978 | Moen et al. | 37/141 R |
| 4,141,161 | 2/1979 | Olson | 37/141 R |
| 4,606,275 | 8/1986 | Grant | 104/10 |
| 4,639,995 | 2/1987 | Garman et al. | 29/402.08 |
| 4,823,486 | 4/1989 | Diekeyers et al. | 37/141 T X |
| 4,848,240 | 7/1989 | Johansson et al. | 104/10 |
| 4,918,843 | 4/1990 | Kiesewetter et al. | 37/142 A |
| 4,932,145 | 6/1990 | Reeves, Jr. | 37/142 R X |

FOREIGN PATENT DOCUMENTS

| | | |
|---|---|---|
| 1016572 | 8/1977 | Canada . |
| 3611493 | 10/1987 | Fed. Rep. of Germany . |

*Primary Examiner*—Dennis L. Taylor
*Assistant Examiner*—Spencer Warnick
*Attorney, Agent, or Firm*—J. W. Burrows

[57] ABSTRACT

Cutting edge assemblies are normally utilized on the leading edge of implements to protect the leading edge of the implement from wear. In order to have a readily removable cutting edge assembly that can be replaced in the field, it is necessary to provide fastening means to retain the respective components to the implement. Since a surface and corresponding holes in the respective elements of the cutting edge assembly must be provided, the respective components are weakened and thus tend to break when used under high load conditions. In this subject arrangement, a cutting edge assembly is provided having a base edge with a scalloped leading edge. A plurality of teeth is provided and each tooth is releasably attached in space relation to the base edge. A plurality of base edge protectors is also provided and each protector is connected to the base edge between the respective teeth of the plurality of teeth. Furthermore, each tooth of the plurality of teeth has a bottom portion which extends rearwardly from a forward end portion and subtends from a top portion thereof between two holes located therein. The plurality of teeth and the plurality of base edge protectors provide a substantially continuous cutting edge for the implement while the bottom portion provides additional strength to the respective teeth.

20 Claims, 9 Drawing Sheets

CUTTING EDGE ASSEMBLY FOR AN IMPLEMENT

DESCRIPTION

1. Technical Field

This invention relates generally to cutting edges for an implement and more particularly to a cutting edge assembly and the individual components thereof.

2. Background Art

Cutting edge assemblies are normally connected to the base edge of an implement to increase the life of the base edge by providing hardened elements, such as adapters and/or base edge protectors, that have increased wear life. It has been known to weld these hardened elements to the base edge, however, it is preferable to have these elements releasably attached. Several known examples of replaceable cutting edges are set forth in U.S. Pat. No. 3,497,973 issued Mar. 3, 1970 to T. G. Campbell, U.S. Pat. No. 3,762,079 issued Oct. 2, 1973 to P. J. Lukavich et al, U.S. Pat. No. 3,851,413 issued Dec. 3, 1974 to P. J. Lukavich, U.S. Pat. No. 3,914,885 issued Oct. 28, 1975 to R. B. Moreau, and German Patent 3,611,493 published Oct. 15, 1987.

In the arrangements in which the adapters are bolted to the base edge, the adapter must be notched out in order to fit over the leading edge of the base edge. Consequently, a notch is created in the adapter at the leading edge of the base edge which creates a weak point where the adapter could readily break when subjected to high loads. In the instances where the adapters are welded to the base edge, it is much more difficult to remove these adapters in order to change them once they have worn out. In order to have the advantage of quickly replacing the adapters and/or protectors in the field, it is best that they be releasably connected to the base edge.

As clearly set forth in the above noted patents, various bolt-on adapters have been utilized in order to solve the problem of having a quickly removable adapter that can be changed in the field. However, in each of these arrangements, a notch is formed in the adapter at the interface of the slot in the adapter and the leading edge of the base edge, which as previously stated, creates a high stress area which may cause breakage whenever the adapter is operated under high load conditions. Other bolt-on adapters are set forth in U.S. Pat. No. 1,856,930 issued May 3, 1932 to P. T. Robin and Canadian Patent 1,016,572 issued Aug. 30, 1977 to L. G. Eftefield.

In most of the arrangements illustrated in the above noted patents, the adapters and/or protectors are bolted on in a conventional manner. In the conventional arrangements, wherein bolts are used to hold the adapters to the base edge and/or to hold the tips to the adapters, problems exists in removing the bolts from the threaded nuts. The problem is attributed to fine dirt compacted in the are of the threads. Furthermore, it is difficult to provide bolts having sheer areas large enough to adequately retain the adapters and/or protectors in place during high load usage. U.S. Pat No. 1,856,930 and Canadian Patent 1,016,572 each set forth arrangements that provide additional sheer area in heavily loaded areas to offset the need for having extremely large bolts. These arrangements still have the shortcoming of requiring the use of bolts and nuts to retain the fastening mechanism in its assembled position.

U.S. Pat. No. 2,688,475 issued Sept. 7, 1954, to E. T. Small, teaches a fastening mechanism wherein a pin is inserted through the tip in the adapter and a malleable metal washer is deformed or bent into its assembled position and secured therein by welding. U.S. Pat. No. 4,639,995 issued Feb. 3, 1987 to J. A. Garman et al, teaches a pin arrangement for a track assembly wherein a deformable metal member is forced into a groove of the pin such that the deformed metal washer fills the cavity within the pin and a corresponding recessed area such that the pin cannot be removed without the deformable metal washer being sheared.

The present invention is directed to overcoming one or more of the problems as set forth above.

DISCLOSURE OF THE INVENTION

In one aspect of the present invention, a cutting edge assembly adapted for connection to an implement is provided. The cutting edge assembly includes a base edge having a scalloped leading edge and a plurality of holes defined therein. The cutting edge assembly also includes a plurality of teeth wherein each tooth of the plurality of teeth is releasably connected to the base edge of the implement. Each tooth of the plurality of teeth has a forward end portion and a rearward end portion. The rearward end portion has a top portion defining a plurality of holes therein and a bottom portion. The bottom portion of the rearward end portion extends from the forward end portion and subtends from the top portion of the rearward end portion at a location between two holes of the plurality of holes. The cutting edge assembly also includes a plurality of base edge protectors. Each protector of the plurality of base edge protectors is releasably connected to the base edge of the implement and located between the respective ones of the plurality of teeth. Each protector of the plurality of base edge protectors has a forward end portion and a rearward end portion having a plurality of holes defined therein. The forward end portion of each protector of the plurality of base edge protectors has a thickness greater than the thickness of the rearward end portion thereof. A shoulder is defined on the forward end portion at the interface between the forward end portion and the rearward end portion thereof. Fastening means is provided in the cutting edge assembly for securing the plurality of teeth and the plurality of base edge protectors to the base edge of the implement.

In another aspect of the present invention, a tooth is provided and adapted for releasable connection to a base edge of an implement wherein the leading edge of the base edge is scalloped. The tooth includes a forward end portion and a rearward end portion. The rearward end portion has a top portion and a bottom portion. A plurality of holes is defined in the top portion and the bottom portion extends from the forward end portion and subtends from the top portion at a location between two holes of the plurality of holes.

In yet another aspect of the present invention, a base edge protector is provided and adapted for releasable connection to the base edge of an implement. The base edge protector includes a forward end portion having a bottom surface, a first side surface angling inwardly and upwardly from the bottom surface, a second side surface angling inwardly and upwardly from the bottom surface, a front surface angling rearwardly and upwardly from the bottom surface, a rear surface substantially perpendicular to the bottom surface, and a top surface. The first side surface, the second side surface, and the front surface each converge with the top surface at a location generally adjacent the top of the rear surface. The base edge protector also has a rear end portion extending from the forward end portion and having a bottom surface co-planar with the bottom surface of the forward end portion, a top surface which is contiguous with and substantially perpendicular to the rear surface of the forward end portion, and two holes are defined therein.

The present invention provides a cutting edge assembly that is releasably connected to an implement and has a plurality of teeth and a plurality of base edge protectors that provide a substantially constant cutting edge that is readily replaceable. Furthermore, each tooth of the plurality of teeth are much stronger since the bottom portion of the rear end portion extends from the forward end portion and subtends from the top portion between two holes thereof and fits within the scallop of the cutting edge. Consequently, the thicker material between the two forward most fastening means that secures the tooth to the base edge is substantially stronger and consequently can withstand much more harsh operating conditions without failure by breakage.

BEST MODE FOR CARRYING OUT THE INVENTION

Figure 1:
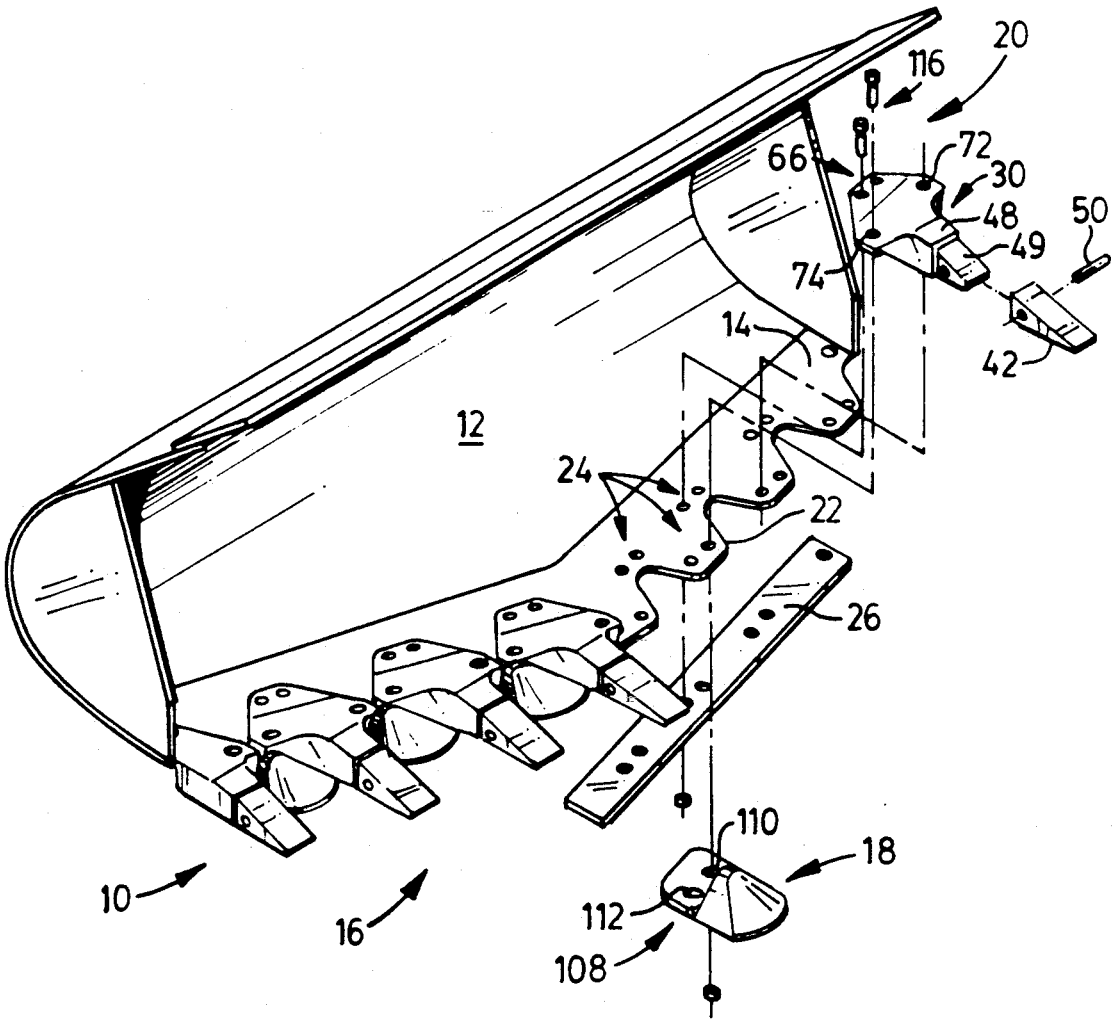
FIG. 1 is an isometric representation of a cutting edge assembly incorporating an embodiment of the present invention.
Figure 2:
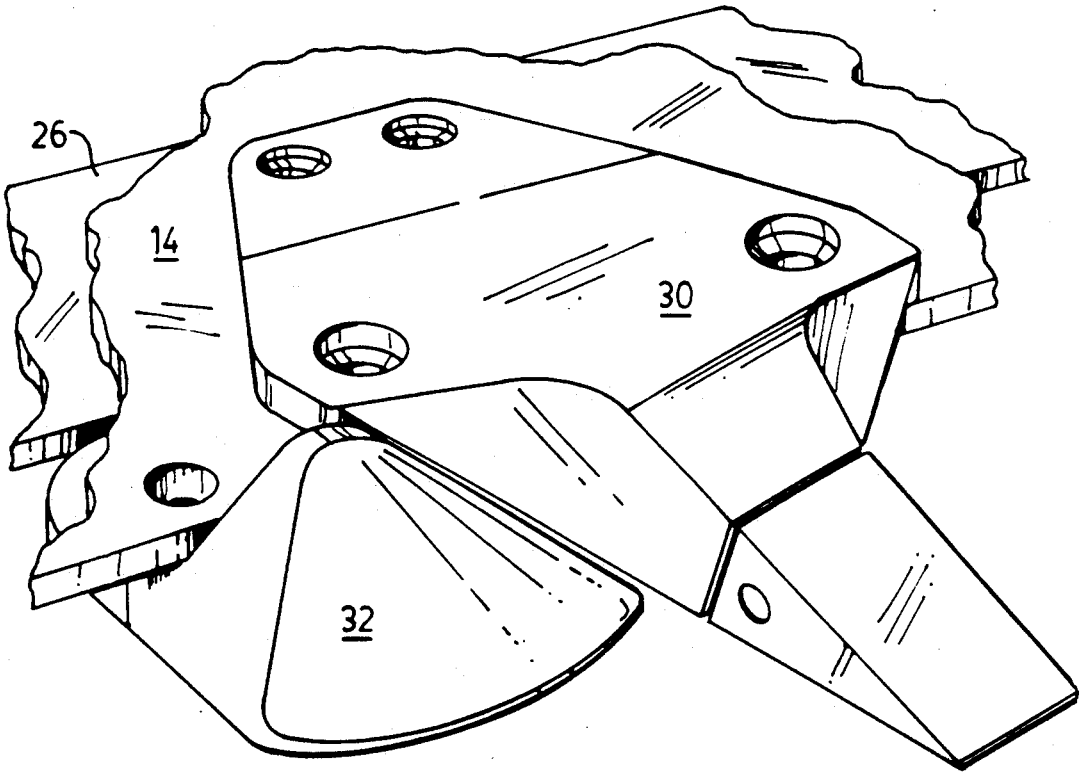
FIG. 2 is an isometric representation of a fragment of a base edge with a tooth and a base edge protector mounted thereon.

Referring now to the drawings, and more particularly to FIGS. 1 and 2, a cutting edge assembly 10 is shown attached to an implement 12. The cutting edge assembly 10 includes a base edge 14, a plurality of teeth 16, a plurality of base edge protectors 18 and fastening means 20.

The base edge 14 has a scalloped leading edge 22 and a plurality of holes 24 defined therein. The base edge 14 is attached to the implement 12 in a conventional manner, such as, by welding.

The plurality of teeth 16 are releasably attached to the base edge. The plurality of teeth 16 and the plurality of base edge protectors 18 are interrelated one with the other as clearly shown on the left side of the implement 12 in FIG. 1 to form a substantially continuous cutting edge in front of the base edge 14. A wear plate 26 is secured to the bottom of the implement 12 behind the plurality of base edge protectors 16 in order to provide an additional wear surface for the bottom of the implement 12.

FIG. 2 illustrates a portion of the cutting edge assembly 10 taken from the implement 12 shown in FIG. 1. More particularly, a tooth 30 of the plurality of teeth 16 and a protector 32 of the plurality of base edge protectors 18 are illustrated in their assembled position on the base edge 14.

Figure 3:
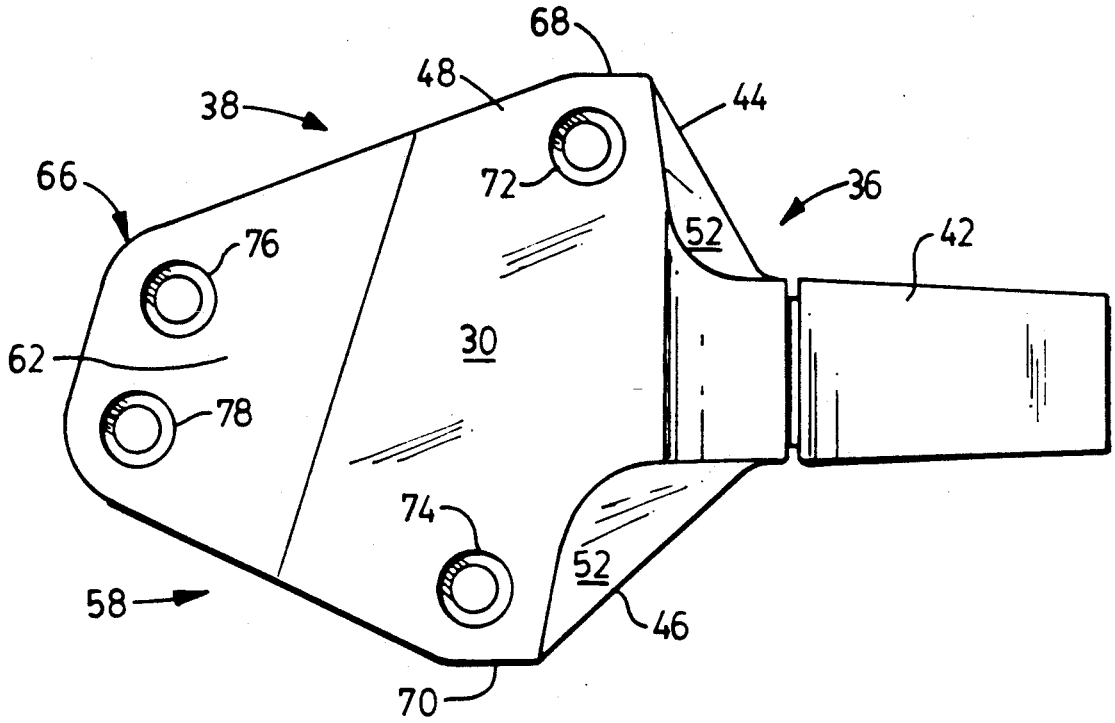
FIG. 3 is a top view of the tooth illustrated in FIG. 2
Figure 4:
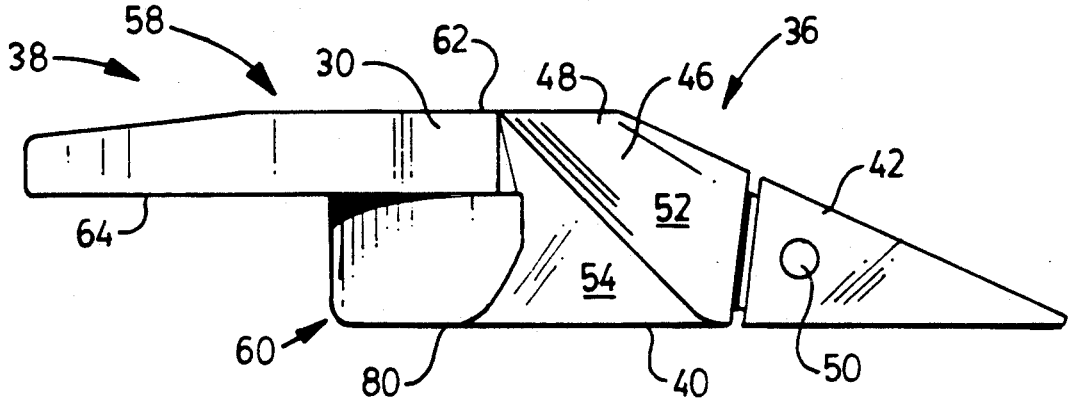
FIG. 4 is a right side view of the tooth illustrated in FIG. 2.
Figure 5:
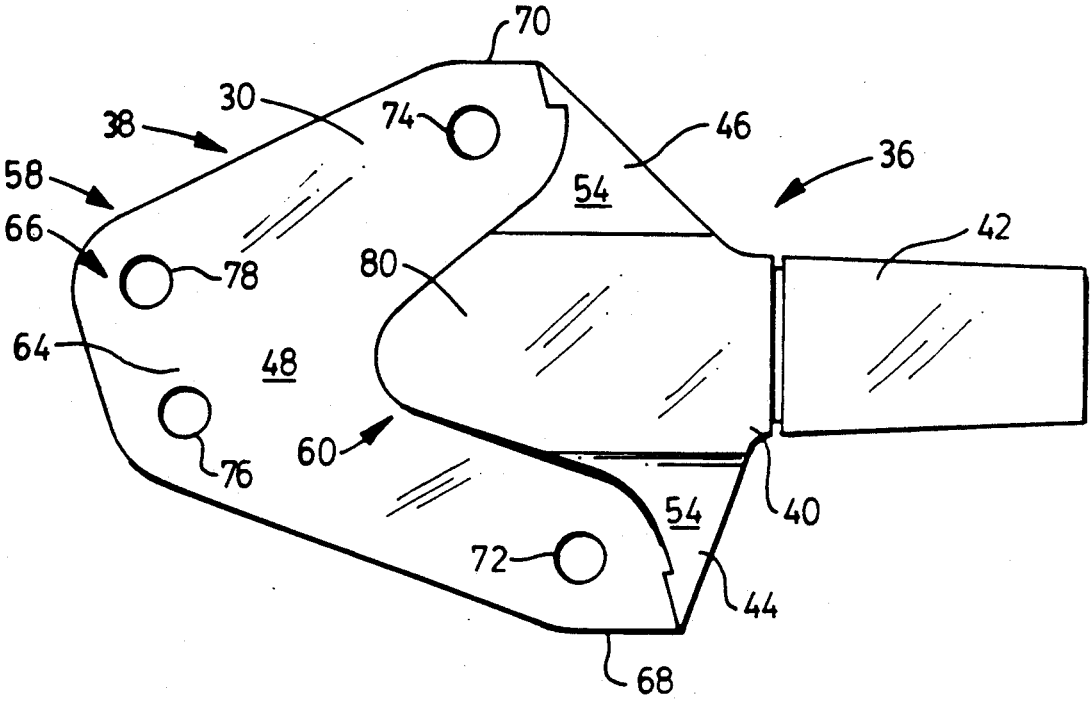
FIG. 5 is a bottom view of the tooth illustrated in FIG. 2.
Figure 6:
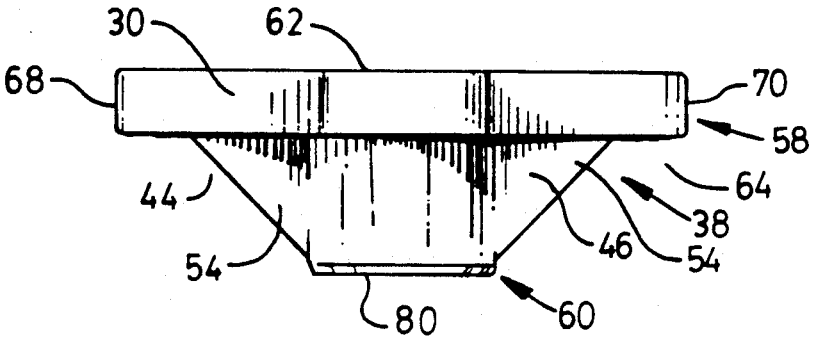
FIG. 6 is a rear end view of the tooth illustrated in FIG. 2.

Referring to FIGS. 3–6, the tooth 30 is illustrated in greater detail. Each tooth 30 has a forward end portion 36 and rearward end portion 38. The forward end portion 36 includes a bottom surface 40, a ground engaging point 42, and first and second re-enforcement ribs 44,46. The ground engaging point 42 as illustrated in FIGS. 3–5 is a replaceable point as better illustrated in FIG. 1. The tooth 30 includes an adapter 48 having a nose 49 for receiving the ground engaging point 42 thereon. The point 42 is retained by a pin 50 or any other conventional means.

The first reinforcement rib 44 is located behind the ground engaging point 42 and on one side of the forward end portion. The second reinforcement rib 46 is located behind the ground engaging point 42 and on the other side of the forward end portion 36. Each of the first and second reinforcement ribs 44,46 has a top surface 52 and a bottom surface 54.

The rearward end portion 38 includes a top portion 58 and bottom portion 60. The top portion 58 includes a top surface 62, a bottom surface 64, and a plurality of holes 66 defined therein. The bottom surface 64 of the top portion 58, when assembled, is in intimate contact with the top surface of the base edge 14. The top surface 62 of the top portion 58 has first and second edges 68,70.

Two holes 72,74 of the plurality of holes 66 are located generally adjacent the forward end portion 36. An additional hole 76 of the plurality of holes 66 is located in the top portion 58 generally adjacent the end thereof distal from the forward end portion 36. Another hole 78 is located in the top portion 58 generally adjacent the end distal from the forward end portion 36 and adjacent the additional hole 76. Each hole of the plurality of holes 66 is counterbored from the top surface 62.

The bottom portion 60 of the rearward end portion 38 extends rearwardly from the forward end portion 36 and subtends from the top portion 58 at a location between the two holes 72,74 of the plurality of holes 66. The bottom portion 60 extends rearwardly to a location short of the additional hole 76 and the another hole 78. The bottom portion 60 has a bottom surface 80 which is co-planar with the bottom surface 40 of the forward end portion 36.

The top surface 52 of the respective re-enforcement ribs 44,46 extends from the bottom surface 40 of the forward end portion 36 at a location spaced forwardly of the interface of the forward end portion 36 and the rearward end portion 38 and upwardly to the top surface 62 of the top portion 58 and outwardly to a location adjacent the respective first and second edges 68,70 of the top surface 62. The bottom surface 54 of the respective reinforcement ribs 44,46 extends from the location generally adjacent the respective edges 68,70 of the top surface 62 inwardly and downwardly to the bottom surface 40 of the forward end portion 36 and forwardly to intersect with the respective top surface 52 of the respective reinforcement ribs 44,46.

Figure 7:
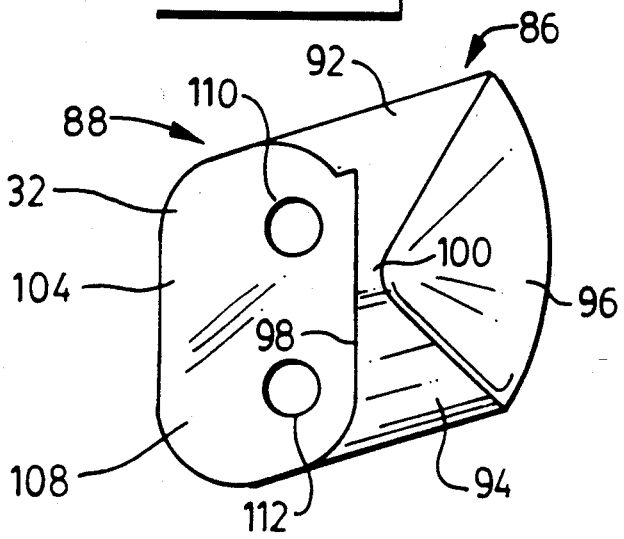
FIG. 7 is a top view of the base edge protector illustrated in FIG. 2.
Figure 8:
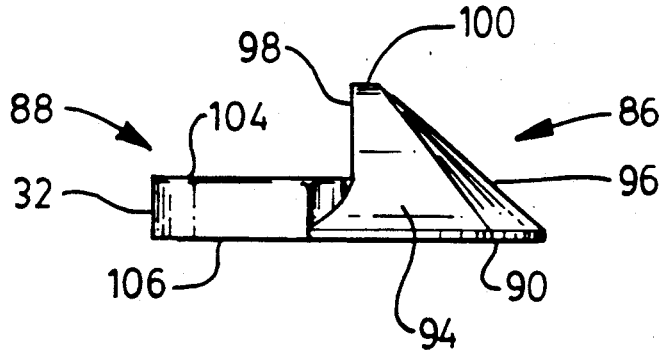
FIG. 8 is a right side view of the base edge protector illustrated in FIG. 2.
Figure 9:
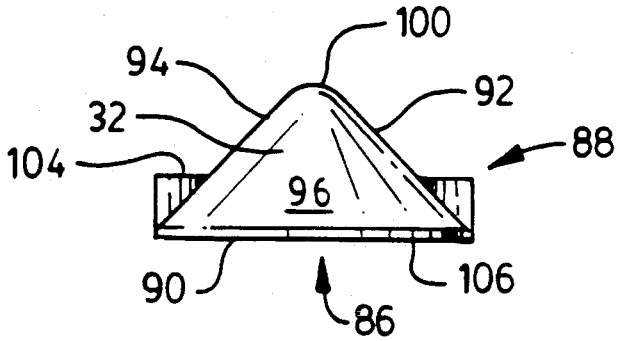
FIG. 9 is a front view of the base edge protector illustrated in FIG. 2.

Referring now to FIGS. 7-9, the base edge protector 32 is illustrated in greater detail. Each protector 32 of the plurality of base edge protectors 18 has a forward end portion 86 and rearward end portion 88. The forward end portion 86 includes a bottom surface 90, first and second side surfaces 92, 94, a front surface 96, a rear surface 98 and a top surface 100. The first and second side surfaces 92, 94 each respectively angle inwardly and upwardly from the bottom surface 90. The front surface 96 angles rearwardly and upwardly from the bottom surface 90 and is a surface of revolution and more specifically may be semi-conical. The rear surface 98 is substantially perpendicular to the bottom surface 90. The first and second side surfaces 92,94, the front surface 96 and the rear surface 98 each converge at the top surface 100 adjacent the rear surface 98.

The rear end portion 88 of the protector 32 includes a top surface 104, a bottom surface 106, and a plurality of holes 108 defined therein. The top surface 104 is contiguous with and perpendicular to the rear surface 98 of the forward end portion 86 to form a shoulder. The bottom surface 106 is co-planar with the bottom surface 90 of the forward end portion 86. The plurality of holes 108 includes first and second holes 110,112 each being located generally adjacent the rear surface 98 of the forward end portion 86. Each hole of the plurality of holes 108 is counterbored from the bottom surface 106 thereof. The top surface 104 of the rearward end portion 88 of each protector 32 of the plurality of base edge protectors 18, when assembled, is in intimate contact with the bottom side of the base edge 14.

Figure 10:
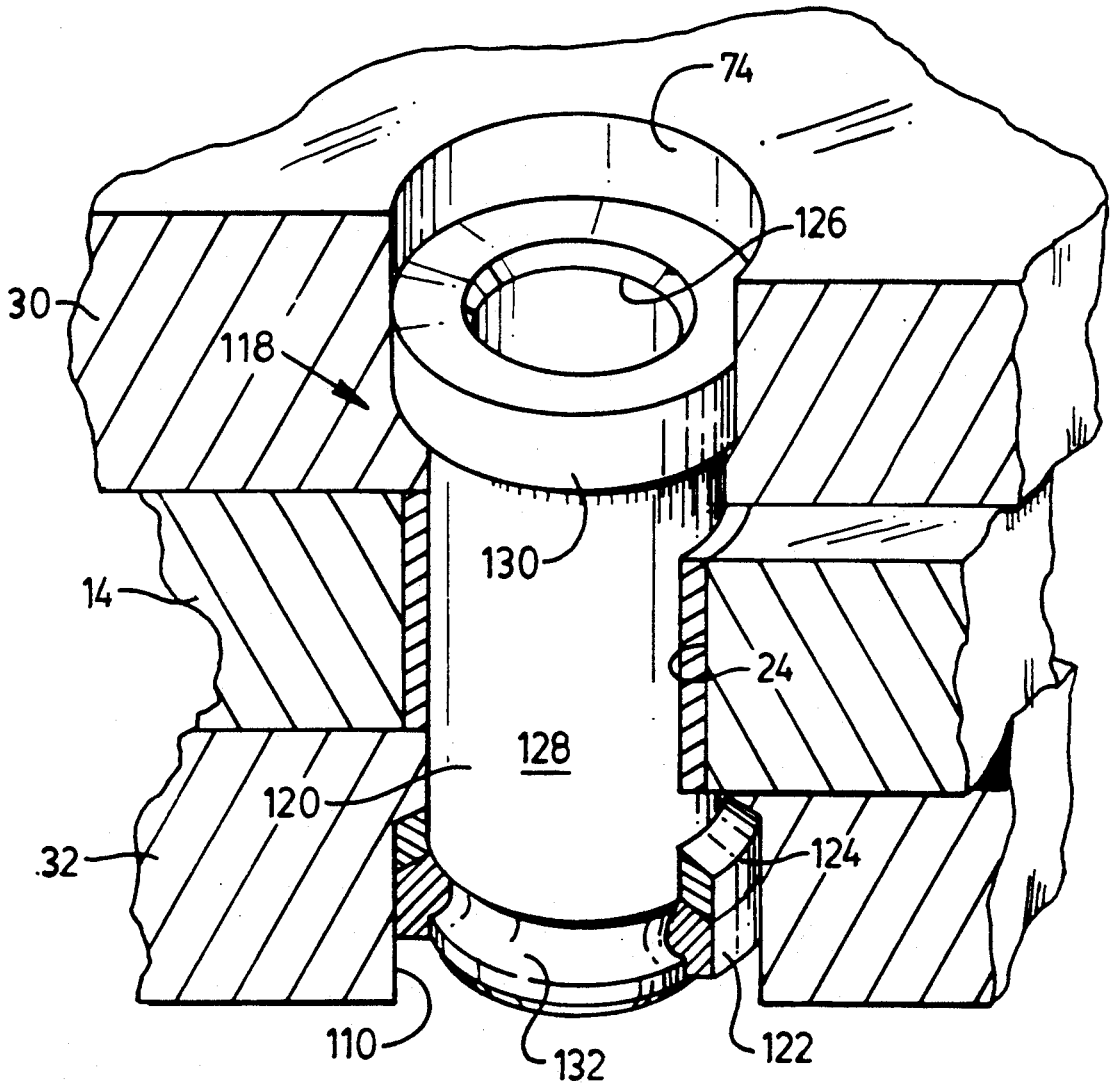
FIG. 10 is a partial section of one of the fastening means generally indicated in FIG. 1.
Figure 11A:
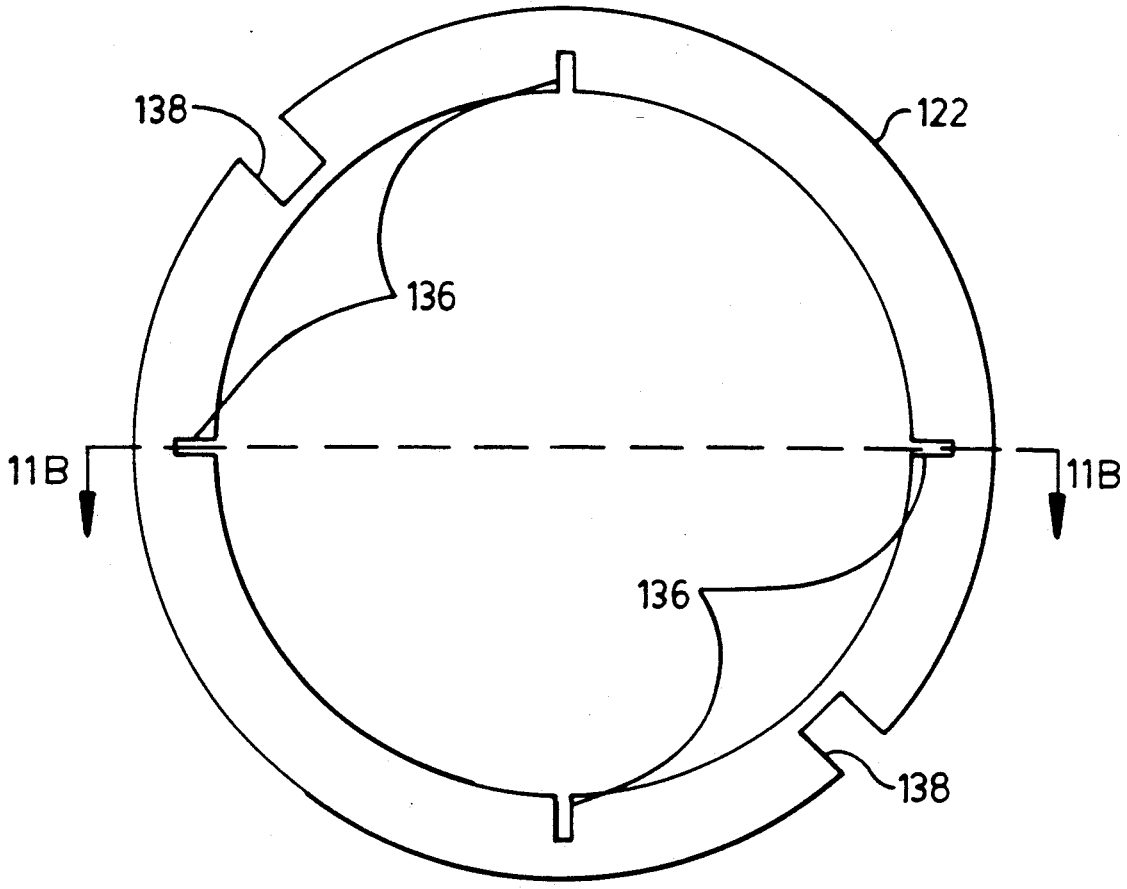
FIG. 11*a* is a top view of a deformable ring.
Figure 11B:
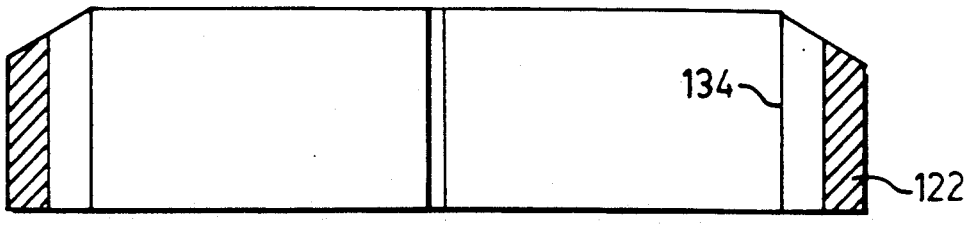
FIG. 11*b* is a sectioned side view of the deformable ring of FIG. 11*a;*

The fastening means 20 of FIG. 1 includes a plurality of fasteners 116. Referring now to FIGS. 10,11*a* and 11*b*, one fastener 118 of the plurality of fasteners 116 is disclosed in greater detail. For illustrative purposes, the fastener 118 connecting the tooth 30 and protector 32 to the base edge 14 is illustrated. Similar fasteners 118 are used in the other holes of the plurality of holes in the tooth 30, the protector 32 and the wear plate 26 to secure them to the base edge 14.

The fastener 118 includes a pin 120, and a deformable ring 122. A hardened washer 124 is also included as a part of the fastener 118 in the embodiment illustrated in FIG. 10. It should be recognized that the hardened washer 124 is optional and is required only when the metal in the mating element (protector or tooth) is a soft material. In order to provide a surface hard enough to resist the forces needed to cause the material of the deformable ring 122 to flow, a hardened material, such as the insert 124, must be located immediately adjacent the deformable ring. The pin 120 as illustrated defines a hole 126 therethrough, a peripheral surface 128, and a flange 130 located at one end of the pin 120. A groove 132 is defined in the peripheral surface 128 adjacent the other end of the pin 120.

The deformable ring 122 defines a hole 134 therein of a size sufficient to, when assembled, slip over the peripheral surface 128 of the pin 120. A plurality of slots 136 are defined in the deformable ring 122 and open at the peripheral surface defining the hole 134 therein. A second plurality of slots 138 are defined in the deformable ring 122 and open to the outer peripheral surface thereof.

The flange 130 of the pin 120 is of a size sufficient to fit in the counterbored hole 74 of the tooth 30 and the pin has a length sufficient for the groove 132 to extend into the counterbored hole 110 of the protector 32. Upon assembly, the pin 120 is inserted through the tooth 30, the base edge 14, and into the protector 32. The optional hardened washer 124 is then inserted into the counterbore of the counterbored hole 110 of the protector 32 and the deformable ring 122 is inserted into the same counterbore around the pin 120. Force is directed against the deformable ring 122 causing the material to flow into the groove 132 of the pin 120 as illustrated in FIG. 10 to secure the fastener 118 therein. It should be understood that the fastener 118 could be inserted from the opposite side of the assembly so that the flange 130 of the pin 120 fits into the counterbored hole 110 of the protector 32 and the deformable ring 122 and insert 124 is inserted in the counterbored hole 74 of the tooth 30.

Figure 12:
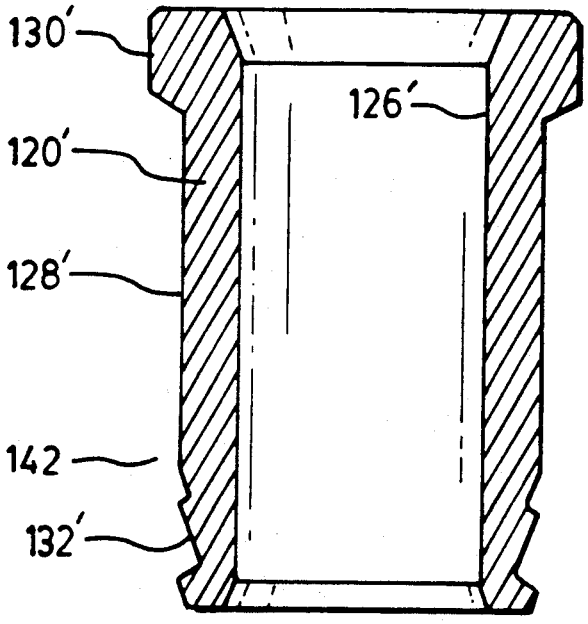
FIG. 12 is a side view of another embodiment of the fastener illustrated in FIG. 10.

Referring now to FIG. 12, a pin 120′ is illustrated. The pin 120′ is another embodiment of the pin 120 illustrated in FIG. 10. The pin 120′ is substantially identical to the pin 120 of FIG. 10 and like portions of the pin 120′ has corresponding element numbers with a prime symbol affixed thereto. The only area of difference between the pin 120′ and the pin 120 of FIG. 10 is that the pin 120′ has a second grooves 142 defined therein. Upon assembly, once the deformable ring 122 is slipped around the peripheral surface 128′ of the pin 120′ and force is applied thereto, the material of the deformable ring 122 is forced to flow into both the first and second grooves 132′,142 to retain the pin 120′ therein.

Figure 13:
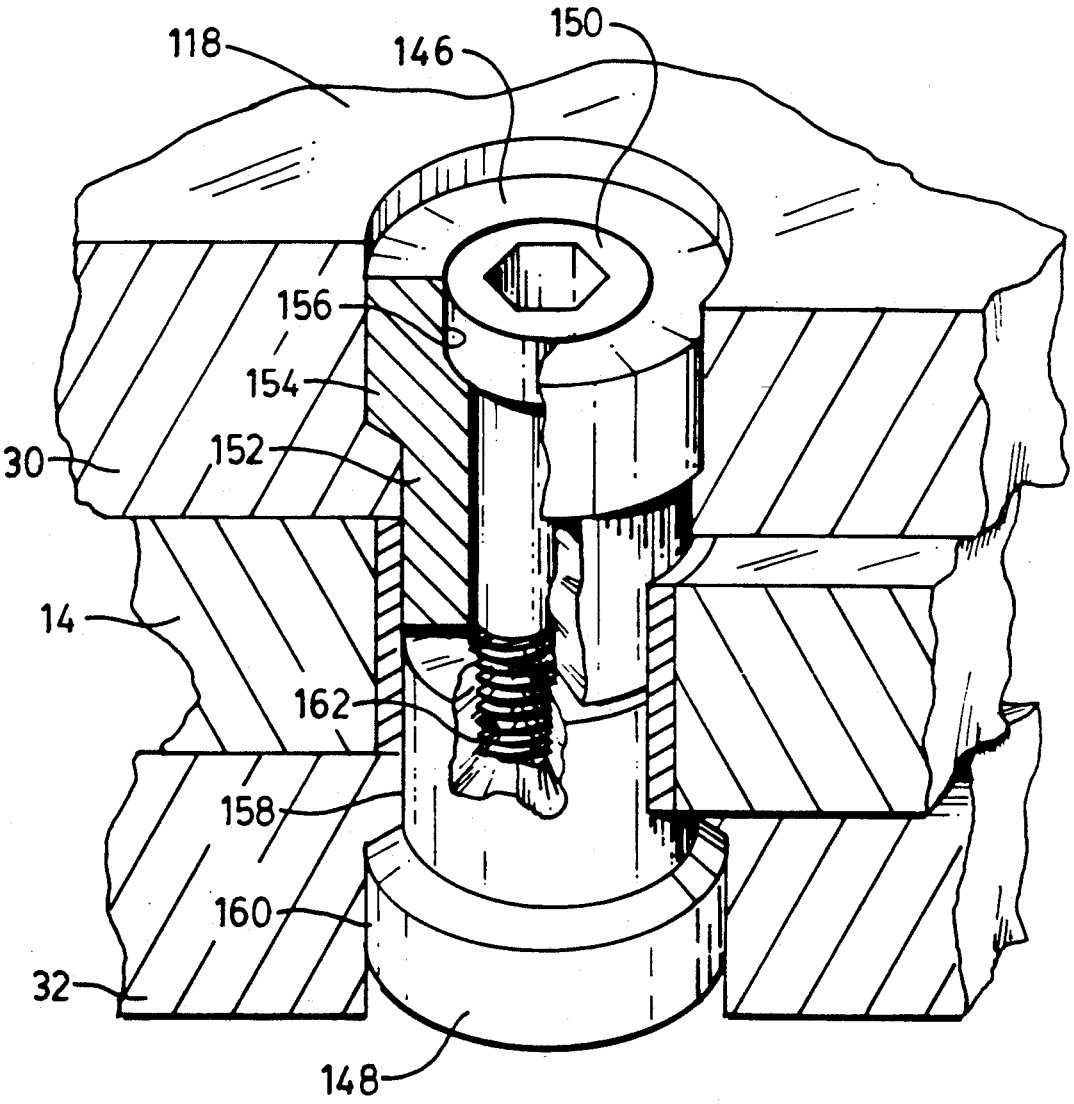
FIG. 13 is the partial section of another embodiment of a fastening means.

Referring to FIG. 13, an alternate embodiment of the fastener 118 is disclosed. The fastener 118 of the alternate embodiment includes a first sleeve 146, a second sleeve 148, and a threaded bolt 150. The first sleeve 146 has a peripheral surface 152, a flange 154 located adjacent one end thereof, and is of a length sufficient, when assembled, for the end of the first sleeve 146 opposite the flange 154 to extend into the base edge 14. A counterbored hole 156 is defined in the first sleeve 146 with the counterbore being on the end of the first sleeve 146 adjacent the flange 154.

The second sleeve 148 has a peripheral surface 158, a flange 160 adjacent one end thereof, and is of a length sufficient, when assembled, for the end of the peripheral surface 158 opposite the flange 160 to extend through the protector 32 into the base edge 14. The second sleeve 148 has a threaded hole 162 defined therethrough. When assembled, the threaded end of the bolt is passed through the counterbored hole 156 of the first sleeve and threaded into the threaded hole 162 of the second sleeve 148 to maintain the first and second sleeves 146,148 in their assembled position.

Figure 14:
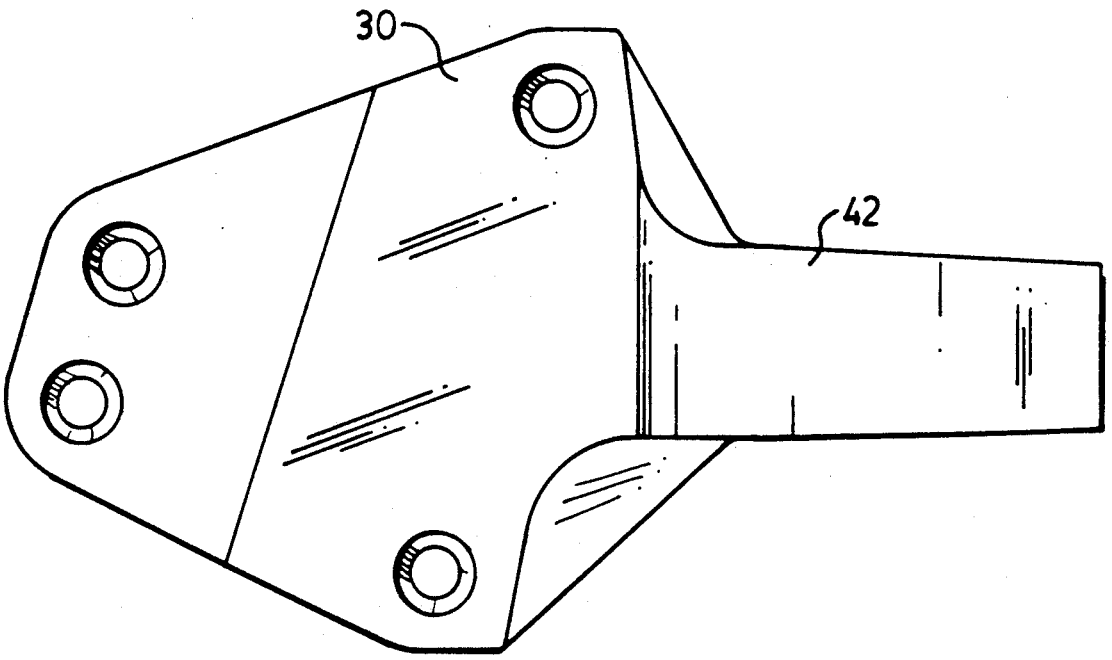
FIG. 14 is a top view of a tooth illustrating another embodiment of the present invention.

Referring now to FIG. 14, an alternate embodiment of the tooth 30 is disclosed. The tooth 30 as set forth herein is a unitooth. In the unitooth 30, the ground engaging point 42 is integral therewith. All other aspects of the unitooth 30 is the same as that set forth for the tooth 30, as described above.

It is recognized that various forms of teeth 30 and protectors 32 may be utilized without departing from the essence of the invention. Likewise, as illustrated in the alternate embodiments, various fastening means may be utilized to attach the respective teeth and protectors to the base edge 14.

INDUSTRIAL APPLICABILITY

Upon assembly, a single fastener 118 extends through one hole 74 of the plurality of holes 66 in the tooth 30, through one hole of the plurality of holes 24 in the base edge 14 and through the hole 110 of the protector 32. Likewise, a fastener extends through the hole 72 of an adjacent tooth 30 and through another hole 24 of the base edge 14 into the second hole 112 of the previously mentioned protector 32. Additional fasteners 118 are utilized in a similar manner to secure the other teeth 30, protectors 32, and wear plates 26 to the base edge 14. The additional fasteners 118 are extended through the additional hole 76 in the respective teeth 30 through respective holes 24 of the base edge 14 into the wear plates 26. Likewise, additional fasteners are used in the hole 78 of respective teeth 30 through holes 24 in the base edge and into the wear plate 26.

The substantially continuous cutting edge provided by the plurality of teeth 16 and the plurality of base edge protectors 18 is accomplished by the interrelationships between the respective teeth 30 and protectors 32. More specifically, the bottom surface 54 of the reinforcement rib 44 is in closely spaced relation, when assembled, with the second side 94 of the protector 32. Furthermore, the bottom surface 54 of the second reinforcement rib 46 of another adjacent tooth 30 is in closely spaced relation to the first side surface 92 of the protector 32. This same relationship between the respective teeth 30 and protectors 32 is continued across the entire front of the base edge 14 as clearly illustrated in FIG. 1.

By having the bottom portion 60 of the rearward end portion 38 extending rearwardly from the forward portion 36 thereof and subtending from the top portion 58 thereof between the two holes 72,74, the tooth 30 is stronger in the critical area. The critical area being an imaginary plane across the tooth 30 at the interface between the forward end portion 36 and the rearward end portion 38. The addition of the bottom portion 60 extending from the forward end portion 36 and subtending from the top portion 58 between the holes 72,74 adds the additional strength necessary to offset breakage during usage in high load applications. Since the area between the holes 72,74 is thicker by the addition of the bottom portion 60 to the top portion 58, the leading edge 26 of the base edge 14 is scalloped providing a space for the bottom portion 60 to fit.

In order to provide protection for the base edge 14 between the respective teeth 30 while still providing ease of flow of the material across the cutting edge 10 of the implement 12, the front surface 96 of the forward end portion 86 of each protector 32 is angled inwardly and upwardly from the bottom surface 90 thereof. In order to provide additional wear material to the respective protectors 32, the front surface 96 is a surface revolution, such as a semi-conical surface.

The fastener 118 as set forth in FIG. 10, provides a fastener that has sufficient shear strength to withstand high forces and by utilizing the deformable ring 122, the connection is made strong and secure. A portable service tool (not shown) is utilized to assemble and disassemble the plurality of fastener 116 in the field. This arrangement eliminates the need for using state of the art bolts and/or the need to weld the respective tooth and or protector to the base edge 14.

The fastener 118 as set forth in FIG. 13 provides good shear strength while requiring the use of a threaded bolt. However, by using the first and second sleeves 146,148, a bolt of a small size is needed instead of one large enough to withstand high shear forces.

It is well recognized by those skilled in the art that the tooth 30, as illustrated in FIG. 1, having an adapter 48 and a replaceable point 42 could be replaced with a tooth 30, as illustrated in FIG. 14, wherein the point 42 is integrally formed without departing from the essence of the invention.

During disassembly of the fastener 118 illustrated in FIG. 10, the deformable ring 122 has to be sheared in order to remove the pin 120. Since only the portion of the deformable ring 122 lying within the groove 132 is sheared, it is necessary to be able to remove that portion from the groove 132. With reference to FIG. **11*b*, the plurality of slots 136 and the plurality of slots 13B are utilized to facilitate the removal of the portion of the deformable ring 122 left within the groove 132. The slots 136,138 are of a sufficient depth that when the pin 120 is removed, the shearing action of the deformable ring 122 passes through the slots 136,138 causing the deformable ring 122 to break into several pieces. Thus, none of the deformable ring 122 remains in the groove 132**.

In view of the foregoing, it is readily apparent that the structure of the present invention provides a cutting edge assembly 10 which has a continuous cutting edge in front of a base edge 14 of an implement 12. Additionally, the bottom portion 60 of the respective teeth 30 adds additional strength to the respective teeth 30 in order to offset breakage thereof during use under high load conditions.

Other aspects, objects and advantages of this invention can be obtained from a study of the drawings, the disclosure and the appended claims.

I claim:

1. A Cutting edge assembly adapted for connection to an implement, the cutting edge assembly comprising:

a base edge having a plurality of holes defined therein and a scalloped leading edge, the base edge being adapted for connection to the implement;

a plurality of teeth, each tooth of the plurality of teeth being releasably connected to the base edge of the implement, each tooth of the plurality of teeth having a forward end portion and a rearward end portion, the rearward end portion having a top portion and a bottom portion, a plurality of holes are defined in the top portion, the bottom portion of the rearward end portion extending from the forward end portion and subtending from the top portion of the rearward end portion at a location between two holes of the plurality of holes;

a plurality of base edge protectors, each protector of the plurality of base edge protectors being releasably connected to the base edge and located between the respective ones of the plurality of teeth, each protector of the plurality of base edge protectors having a forward end portion and a rearward end portion having a plurality of holes defined therein, the forward end portion of each protector of the plurality of base edge protectors has a thickness greater than the thickness of the rearward end portion thereof and a shoulder defined on the forward end portion at the interface between the forward end portion and the rearward end portion; and fastening means for securing the plurality of teeth and the plurality of base edge protectors to the base edge.

2. The cutting edge assembly as set forth in claim 1, wherein the forward end portion of each tooth of the plurality of teeth and the forward end portion of each protector of the plurality of protectors form a substantially continuous cutting edge in front of the base edge.

3. The cutting edge assembly as set forth in claim 2, wherein the two holes of the plurality of holes in the rearward end portion of each tooth of the plurality of teeth are located generally adjacent to the forward end portion thereof.

4. The cutting edge assembly as set forth in claim 3, wherein the bottom portion of the rearward end portion of each tooth of the plurality of teeth is located in a respective scallop of the scalloped leading edge.

5. The cutting edge assembly as set forth in claim 4, wherein the rearward end portion of each tooth of the plurality of teeth is connected to one side of the base edge and the rearward end portion of each protector of the plurality of protectors is connected to the other side of the base edge.

6. The cutting edge assembly as set forth in claim 5, wherein when assembled one hole of the two holes of the plurality of holes in the top portion of one tooth of the plurality of teeth, is in alignment with one hole of the plurality of holes in the base edge and one hole of the plurality of holes in the rearward end portion of one protector of the plurality of protectors.

7. The cutting edge assembly as set forth in claim 6, wherein the other hole of the two holes of the plurality of holes in the top portion of another tooth of the plurality of teeth is in alignment with another hole of the plurality of holes in the base edge and another hole of the plurality of holes in the one protector of the plurality of protectors.

8. The cutting edge assembly as set forth in claim 7, wherein each tooth of the plurality of teeth includes an adapter and a removable ground engaging point.

9. The cutting edge assembly as set forth in claim 7, wherein each tooth of the plurality of teeth is a unitooth.

10. The cutting edge assembly as set forth in claim 7, wherein each hole of the plurality of holes in the plurality of teeth and in the plurality of base edge protectors is counterbored from the side opposite the side that contacts the base edge.

11. The cutting edge assembly as set forth in claim 10, wherein the fastening means includes a plurality of fasteners and each fastener includes a pin having a peripheral surface and a deformable ring, the pin having a flange on one end which fits into the respective counterbored hole of the tooth or protector, a groove is defined in the peripheral surface of the pin adjacent the end opposite to the flange and the grove on the pin extends through the one hole of the base edge into the respective counterbored hole of the other of the tooth or protector, and the deformable ring fits around the groove on the pin that extends into the respective counterbored hole, whereby the application of force to the deformable ring forces the material of the deformable ring to flow into the groove of the pin to secure the pin therein.

12. The cutting edge assembly as set forth in claim 11, wherein a second groove is defined in the peripheral surface of the pin adjacent the first groove and the material from the deformable ring is forced to flow into both the first and second grooves to secure the pin therein.

13. The cutting edge assembly as set forth in claim 11, including a hardened washer disposed between the bottom of the counterbore of the counterbored hole of the tooth or protector and the deformable ring.

14. The cutting edge assembly as set forth in claim 10, wherein the fastening means includes a plurality of fasteners and each fastener includes a first sleeve having a peripheral surface, a second sleeve having a peripheral surface, and a threaded bolt.

15. The cutting edge assembly as set forth in claim 14, wherein the first sleeve has a counterbored hole defined therethrough and a flange on the peripheral surface thereof adjacent one end, said flange being fitted into the respective counterbored hole of the tooth or protector and has a length sufficient to extend through the tooth or protector and partially into the one hole of the plurality of holes in the base edge, the second sleeve having a threaded hole defined therethrough and a flange on the peripheral surface thereof adjacent one end, said flange being fitted into the respective counterbored hole of the other one of the tooth or protector and has a length sufficient to extend through the other one of the tooth or protector into the corresponding hole in the base edge, the threaded bolt being inserted into the counterbored hole of the first sleeve and threaded into the threaded hole of the second sleeve to secure the tooth and protector to the base edge.

16. A tooth adapted for releasable connect to a base edge of an implement wherein a leading edge of the base edge is scalloped, the tooth comprising:

a forward end portion; and a rearward end portion having a top portion and a bottom portion, a plurality of holes being defined in the top portion with two holes thereof spaced from one another and being generally adjacent the forward end portion, an additional hole thereof located generally adjacent the end thereof distal from the forward end portion, and another hole thereof located generally adjacent the distal end and adjacent the additional hole, the bottom portion extending from the forward end portion and subtending from the top portion, the bottom portion is connected to the top portion at a location between the two holes of the plurality of holes and extends rearwardly to a location short of the additional hole and the another hole and the top portion of the rearward end portion has a top surface and the forward end portion has a bottom surface and includes a re-enforcement rib on each side of the forward end portion to interconnect the rearward end portion with the forward end portion.

17. The tooth as set forth in claim 16, wherein the top surface of the top portion of the rearward end has a top and bottom surface, the top surface extends from the bottom surface of the forward end portion at a location spaced forwardly of the interface of the forward end portion and the rearward end portion rearwardly and upwardly to the top surface of the top portion and outwardly to a location adjacent the one of the edges of the top surface of the top portion. the bottom surface of each re-enforcement rib extends from a location generally adjacent the edge of the top surface of the top portion inwardly and downwardly to the bottom surface of the forward end portion and forwardly to intersect with the top surface of the re-enforcement rib.

18. The tooth as set forth in claim 17, wherein each hole of the plurality of holes is counterbored.

19. The tooth as set forth in claim 18, wherein the tooth is a unitooth having the ground engaging point integral therewith.

20. The tooth as set forth in claim 18, wherein the tooth includes an adapter and the forward end portion has a nose adapted to receive a ground engaging point.

* * * * *

UNITED STATES PATENT AND TRADEMARK OFFICE

CERTIFICATE OF CORRECTION

PATENT NO. : 5,077,918

DATED : January 7, 1992

INVENTOR(S) : JAMES A. GARMAN

It is certified that error appears in the above-identified patent and that said Letters Patent is hereby corrected as shown below:

Claim 16, column 10, line 31, please delete "connect" and insert --connection--.

Claim 17, column 10, line 56, after "rearward end", please insert --portion has respective edges and each of the re-enforcement ribs--.

Signed and Sealed this

Twenty-third Day of March, 1993

*Attest:*

STEPHEN G. KUNIN

*Attesting Officer*

*Acting Commissioner of Patents and Trademarks*